US009212874B1

(12) United States Patent
Harding

(10) Patent No.: US 9,212,874 B1
(45) Date of Patent: Dec. 15, 2015

(54) SELF CENTERING SPIN NOCK

(71) Applicant: Martin Dale Harding, Van Alstyne, TX (US)

(72) Inventor: Martin Dale Harding, Van Alstyne, TX (US)

( * ) Notice: Subject to any disclaimer, the term of this patent is extended or adjusted under 35 U.S.C. 154(b) by 0 days.

(21) Appl. No.: 14/305,852

(22) Filed: Jun. 16, 2014

(51) Int. Cl.
*F42B 6/06* (2006.01)

(52) U.S. Cl.
CPC ..... *F42B 6/06* (2013.01)

(58) Field of Classification Search
CPC ..... F42B 6/06
See application file for complete search history.

(56) References Cited

U.S. PATENT DOCUMENTS

| | | | | | |
|---|---|---|---|---|---|
| 4,978,130 | A * | 12/1990 | Farler | 473/586 |
| 5,306,020 | A * | 4/1994 | Bolf | 473/578 |
| 5,823,902 | A * | 10/1998 | Guest et al. | 473/578 |
| 5,919,105 | A * | 7/1999 | Summers | 473/578 |
| 6,478,700 | B2 * | 11/2002 | Hartman | 473/578 |
| 8,257,208 | B2 * | 9/2012 | Harding | 473/578 |
| 8,267,816 | B1 * | 9/2012 | Hajari | 473/578 |

* cited by examiner

*Primary Examiner* — John Ricci
(74) *Attorney, Agent, or Firm* — Jeffrey Roddy

(57) ABSTRACT

A nock for promoting a natural spin on an arrow shaft prior to the nock separating from a bowstring includes a nock segment possessing a bowstring rest portion, and a base portion which is coupled to a retaining portion via a collar portion. The retainer is attached to the end of an arrow shaft. The nock segment freewheels independently of the retainer and the arrow shaft to permit the arrow fletching moving through the air to act on the shaft inducing a natural spin to the shaft prior to separation of the bowstring and the nock.

5 Claims, 9 Drawing Sheets

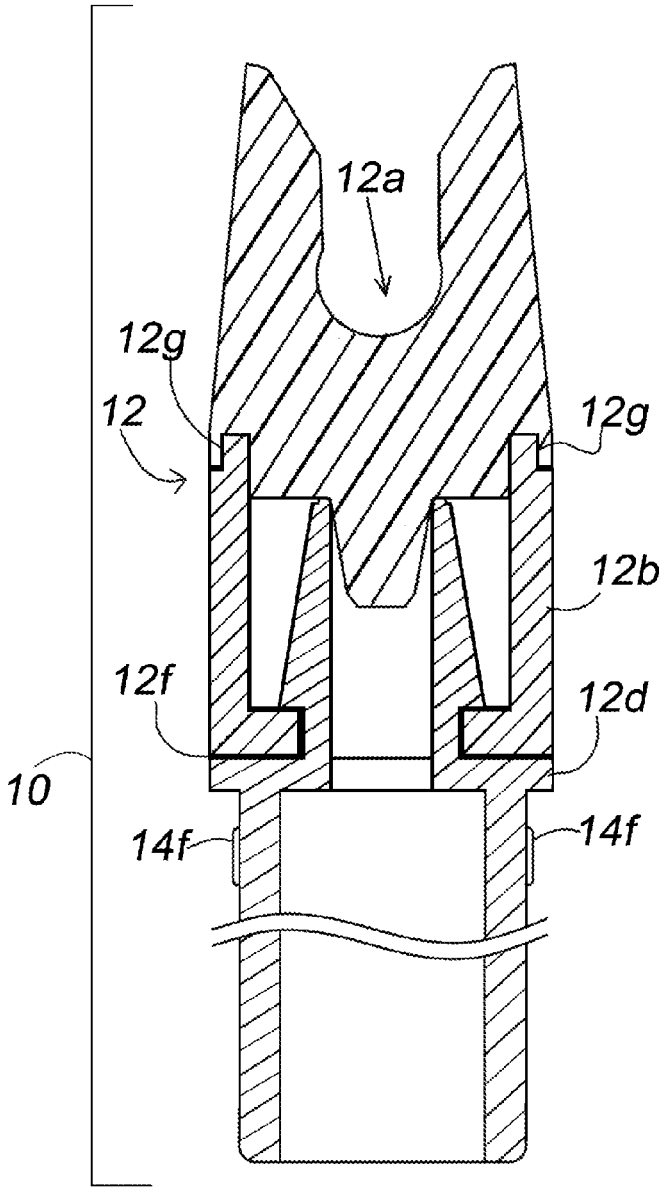
FIG.6
FIG.7
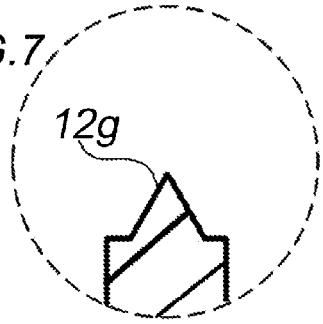
FIG.8
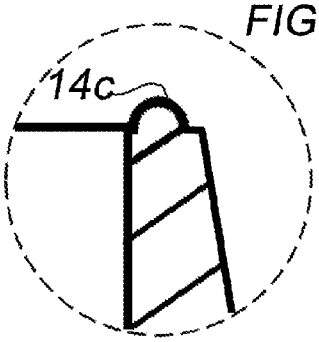
FIG.8a
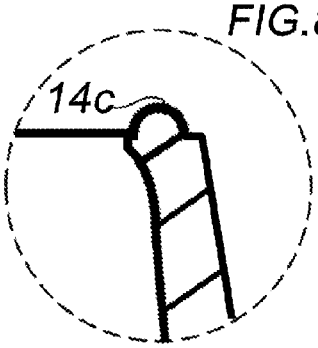

SELF CENTERING SPIN NOCK

FIELD

The invention relates generally to the practice of archery, bowhunting, and more particularly, arrow nock construction.

BACKGROUND OF THE INVENTION

An archer's bow is a simple machine in which the limbs define a two-arm spring. An arrow consists of a forward tip which may be a target point type or a broadhead type affixed to one end of a shaft which is typically made from wood, fiberglass, metal or other suitable material, a nock for resting against a bowstring, and fletching, also known as fins or vanes, which are affixed to the shaft just ahead of the nock for purposes of aerodynamic stabilization during flight. The archer stores energy in the form of the drawn stressed bow. When the archer releases the bowstring permitting the bow limbs to spring forward kinetic energy is then transferred to the arrow. Among several factors affecting the distance an arrow flies are the initial angle, initial velocity, arrow weight, length of the arrow, and the size and shape of the arrow fletching. Spin influences directional stability which is the stability of a moving body about an axis. Drag stability is directional stability produced by the fletching on the arrow shaft. Rate of spin is determined by vane geometry and more specifically to the fletching scheme which may be straight, offset or helically oriented. Both offset and helical configurations will cause the shaft to spin; with a helical fletching configuration producing a relatively higher rate of shaft rotation.

When preparing to shoot an arrow, the nock of the shaft is temporarily mounted to the bowstring which is then drawn back, deforming the bow which acts as a store of potential energy. Conventional (fixed) nocks are typically one-piece and attached to one end of the arrow shaft. A fixed nock possesses a static bowstring rest that when engaged with the bowstring, prevents the arrow shaft from assuming a spin induced by the fletching during the initial release phase of the arrow which is the time from bowstring release by the archer to bowstring separation from the nock. Accordingly, with fixed nocks, it is only after the nock separates from the bowstring that rotation of the arrow shaft can begin to occur. Thus, a conventional nock (1) robs the arrow of energy by immobilizing the arrow shaft and preventing fletching rotation when moving through the air, which produces drag on the arrow during the initial release phase, and (2) interferes with early stabilization that would occur at the onset of release if the arrow were somehow permitted to begin spinning during the initial release phase.

What is needed is a nock assembly that permits natural rotation of the fletching during the initial release phase by allowing the rotation of the shaft imparted by the fletching configuration moving through the air to occur immediately after the archer releases the drawn bowstring—and prior to separation of the nock from the bowstring. Such a nock would (1) reduce wind resistance by allowing the fletching to promote a natural spin of the arrow immediately upon bow string release, (2) increase stabilization of the shaft by permitting early spin and (3) eliminate string torque which is caused by non-uniform forces present when portions of a fixed nock contacting the moving bowstring are forced angularly against the bowstring due to the natural tendency of helical fletching to attempt rotation when moving forward. Because the nock is radially torqued against the bowstring by the rotation of the fletching acting on the shaft, the torquing introduces destabilizing forces to the arrow shaft. In some cases, the arrow after separating from the bowstring and immediately after leaving the bow will attempt to maintain the rotational direction imparted by the torqued string and can be seen to reverse its rotation. This torquing effect has been confirmed by slow motion video. Finally, for at least the reasons given above, a nock permitting the free rotation of an arrow shaft when still engaged with a bowstring should, assuming the same shooter and gear, provide a relatively greater degree of accuracy.

Various devices in the past have struggled with the problem of promoting arrow spin; typically once the nock separates from the bowstring. However, many such devices have included springs or spiraled guides that interfere with the natural tendencies of helical fletching to rotate the arrow shaft to assume a natural rotational equilibrium consistent with fletching geometry and other physical factors present at release, i.e., mass of the arrow, density of air, and the thrust imparted by the bow. It is known that the faster an object spins, the greater the inertia. Accordingly, induced rotation exceeding natural rotation robs energy from the bow which reduces kinetic energy available for forward motion of the arrow. Still another problem with devices that artificially increase rotation is the straining of the bowstring rest portion of the nock torquing against the bowstring when thrust forward by the released bowstring. In cases of artificially inducing a rotational velocity exceeding that which would otherwise occur if the nocked arrow shaft were passively allowed to commence rotation when moving through the air, the moving arrow shaft is destabilized by increasing air turbulence around the fletching during the initial release phase; after which, the rotational rate experiences a correction by air resistance acting on the fletching slowing the rotation. The correction to artificially induced rotational speed can be sudden. In the case of a mass encountering a resistive fluid at a velocity beyond which the fluid can efficiently accomodate, much turbulence is produced as molecules of the fluid collide with each another and the moving mass. In other words, the more turbulence produced, the greater the destabilizing forces acting on the arrow shaft. When natural rotation is permitted to occur, the air molecules pass less chaotically around the fletching and allow the arrow to move forward in a relatively smooth trajectory.

It would be desirable to promote a natural spin of an arrow shaft by the rotation of fletching during the initial acceleration phase of an arrow's release.

It would be desirable to reduce the drag upon the fletching of an arrow during the initial acceleration phase of an arrow's release and from that time immediately after the initial acceleration phase when the arrow separates from the bowstring until the fletching is able to adequately rotate the shaft.

It would be desirable to increase the travel for a released arrow.

It would be desirable to increase the stability of an in-flight arrow.

It would be especially desirable to eliminate torquing of the nock relative to the bowstring at the instant of nock-bowstring separation, by providing a freely rotatable nock which provides low-friction rotation of the nock when still engaged with the bowstring.

In keeping with the foregoing, it would be desirable to improve the accuracy of arrow flight.

SUMMARY OF THE INVENTION

The present invention comprises a nock assembly 10 that includes a nock portion 12 having a bowstring rest portion 12*a*, a collar portion 12*b* with upper and lower annuli (12*c*, 12*d*) nock base 12*e*, and a retainer portion 14 with shaft coupler 14*b*, for attaching the nock assembly to an arrow shaft. Collar portion 12*b* is generally tubular with at least one inwardly directed circumferential lip 13 that interlocks with retainer 14 but is rotationally free to move axially about the retainer. The retainer shaft coupler 14*b* is typically inserted into a recess or hollow at one end of an arrow shaft 16. The shaft coupler is fixed to the arrow shaft by a number of protrusions or tabs 14*f* on the outside of the retainer body which are friction fitted into the shaft recess or aperture by pressing the shaft coupler into one end of the arrow shaft. While preferably, prior to assembly, the collar and bowstring rest portion 12*a* are separate, collar portion 12*b* can be joined with the bowstring rest portion by sonic welding, gluing or other means as will suggest itself to those skilled in the art having benefit of this disclosure. Collar 12*b* retains the nock portion to the retainer portion by means of lip 12*i* which interlocks with the retainer portion beneath projection 14*a* and plate 14*d*. The bowstring rest and collar rotate together, with thrust bearing 14*c* topping projection 14*a* for contact with bowstring rest bottom 12*e*.

Bowstring rest portion 12*a*, collar 12*b* and retainer portion 14 are coaxially aligned with each other and the arrow shaft. The use of injection molded parts having a low coefficient of friction and the tolerances made possible by sonic welding assembly of the nock and collar, produces wobble free rotation which transfers energy efficiently from the bowstring to the arrow shaft. Because portions of the nock rotate in relation to one another with very little resistance, arrow shaft 16 is permitted to commence rotation prior to separation from the bowstring. The result is a rotational force upon the shaft consistent with shaft velocity, vane configuration and air resistance, inducing the retainer portion and arrow shaft to commence rotation prior to disengagement from the bowstring. The arrow shaft rotates naturally and efficiently with minimized air resistance with no bowstring torque prior to or at separation from the bowstring. The vanes continue their natural rotation in the same direction after the bowstring separates from the nock, thus minimizing drag on the arrow and promoting arrow stabilization.

While examples discussed herein are directed generally to a freely spin-able nock assembly for an arrow, the description that follows is not intended to limit the scope of the invention to the particular forms set forth, but on the contrary, it is intended to cover such alternatives, modifications, combinations and equivalents as may be included within the spirit and scope of the invention as set forth in the detailed description of the embodiments which folows and the appended drawing figures in which scaling of the individual elements is approximate.

BRIEF DESCRIPTION OF THE DRAWINGS

FIG. 6 is a cross-sectional view taken along lines 6'-6' of the nock assembly shown in (FIG. 3);

FIG. 7 is a detail view of call-out (7) of (FIG. 5);

FIG. 8 is a detail view of call-out (8) of (FIG. 5);

FIG. 8*a* is a detail view of an alternate geometry that corresponds to the region of the retainer circumscribed by call-out (8) of (FIG. 5);

DETAILED DESCRIPTION OF THE EMBODIMENTS

Reference Listing

Figure 1:
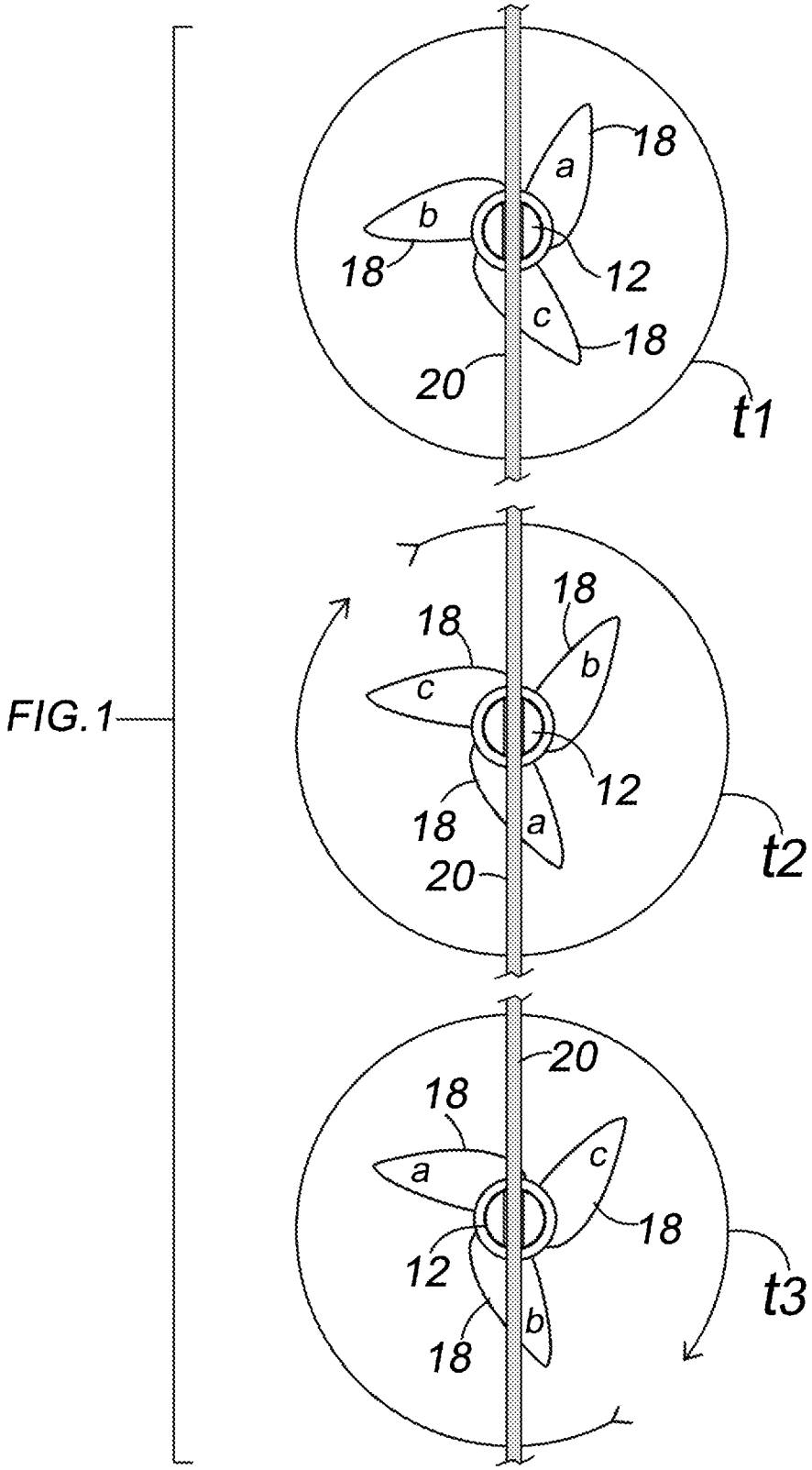
FIG. 1 in a preferred embodiment, an arrow release sequence (t1, t2, t3) is shown from the nock end when engaged with a bowstring and during initial release.
Figure 2:
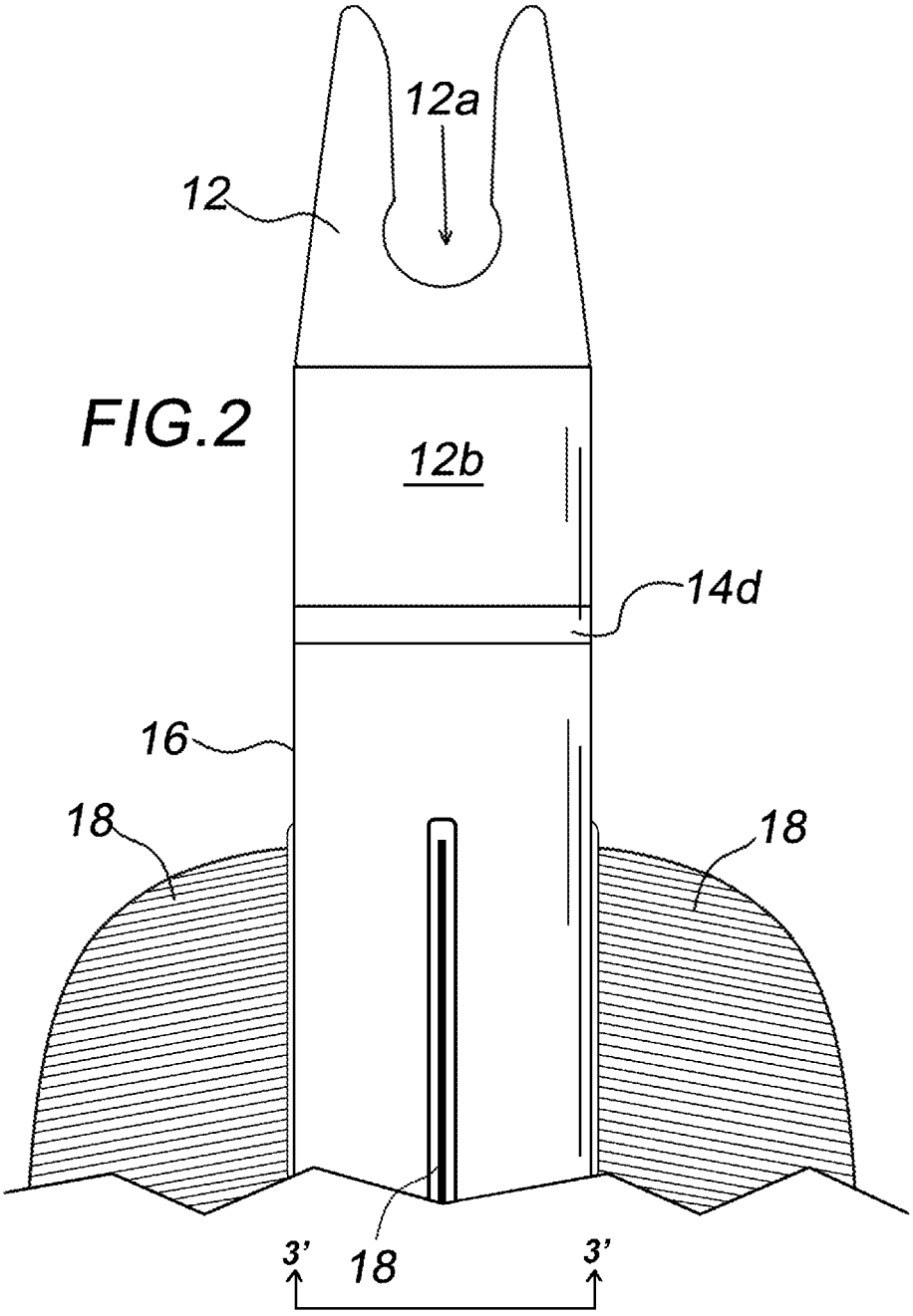
FIG. 2 in a preferred embodiment, is a plan view of nock assembly 10 with nock portion 12, collar, and retainer portion 14 mounted to an arrow shaft 16.

10' nock assembly
12 nock portion
12*a* bowstring rest portion
12*b* collar
12*c* upper collar annulus
12*d* lower collar annulus
12*e* bowstring rest portion bottom
12*f* interlocking members
12*g* joint
12*h* race
12*i* lip
14 retainer assembly
14*a* projection
14*b* shaft coupler
14*c* thrust bearing
14*d* plate
14*f* friction fit tabs
16 arrow shaft
18 fletching
20 bowstring

DEFINITIONS

The term "run-out" is a measure of the amount of off-centeredness of a rotating component. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Referring generally to FIGS. 1-11; preferred embodiments according to the present invention include a nock portion 12 a bowstring rest 12*a*, and a collar 12*b* which connects the bowstring rest portion to retainer portion 14 and serves as an alignment and spacing means for the nock portion. It should be noted that in the embodiments shown herein, the respective nock assemblies can be outwardly similar in appearance. Collar 12*b* possesses an upper annulus 12*c*, the perimeter of which is ultrasonically welded to the bowstring rest portion

12*a* and a lower annulus 12*d* surrounded by lip 12*i* which is snap-fitted over and around projection 14*a*. The lower annulus is relatively narrow, but sized and shaped to permit the relatively narrow end of projection 14*a* to irreversibly enter therein producing an interlocking arrangement. When surrounded by collar 12*b*, an upper region of the projection defines a thrust bearing 14*c* for contact with the underside of the bowstring rest portion forming a race 12*h*, which can include a flat surface or concavity. Portions of the bowstring rest or projection receive one another and are forced together by acceleration during the initial release phase pushing the bottom of the bowstring rest portion which defines a race 12*h* against the thrust bearing surface 14*c* of the projection 14*a* which can be tapering or truncated, or possessing of a recess for insertion of part or portions of the bowstring rest portion bottom 12*e*, and produces self centering of the retainer relative to the nock portion which reduces total indicated run-out when rotating during initial acceleration.

Figure 3:
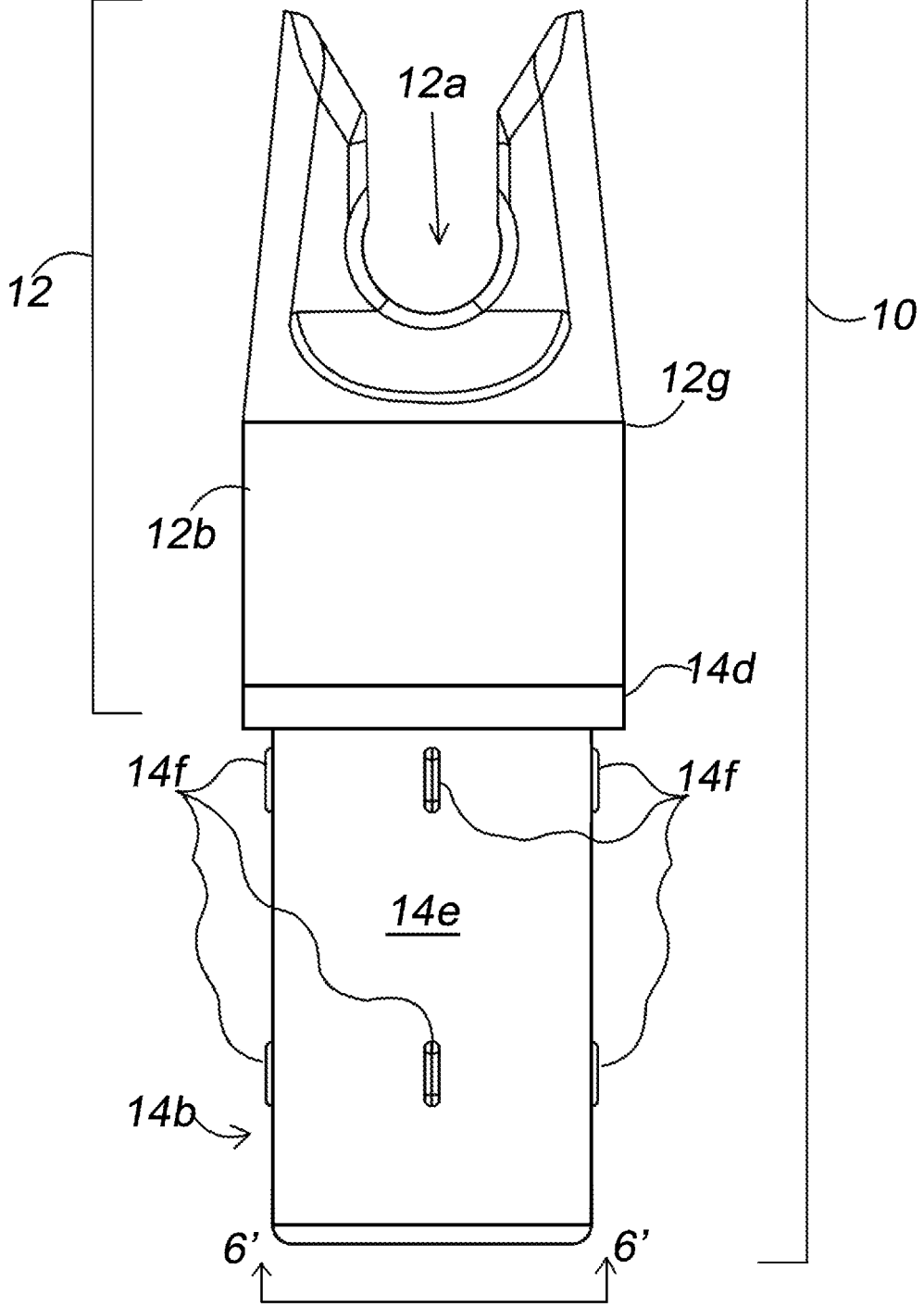
FIG. 3 a preferred embodiment according to the present invention, is a plan view of nock assembly 10, separated from the arrow shaft.

FIG. 3 shows a nock assembly 10 when assembled in accordance with the present invention, and prior to attachment to an arrow shaft.

While the particular embodiment shown herein is intended for insertion into the end of a hollow arrow shaft 16 (FIG. 2), it is possible that the retainer assembly 14 may be modified to fit into the end of an arrow shaft by threading or be affixed thereto by other means as would suggest itself to one having skill in the art. Nock assembly 10 can be incorporated with an arrow shaft by a manufacturer, or retrofitted to an arrow shaft by a consumer.

Figure 4:
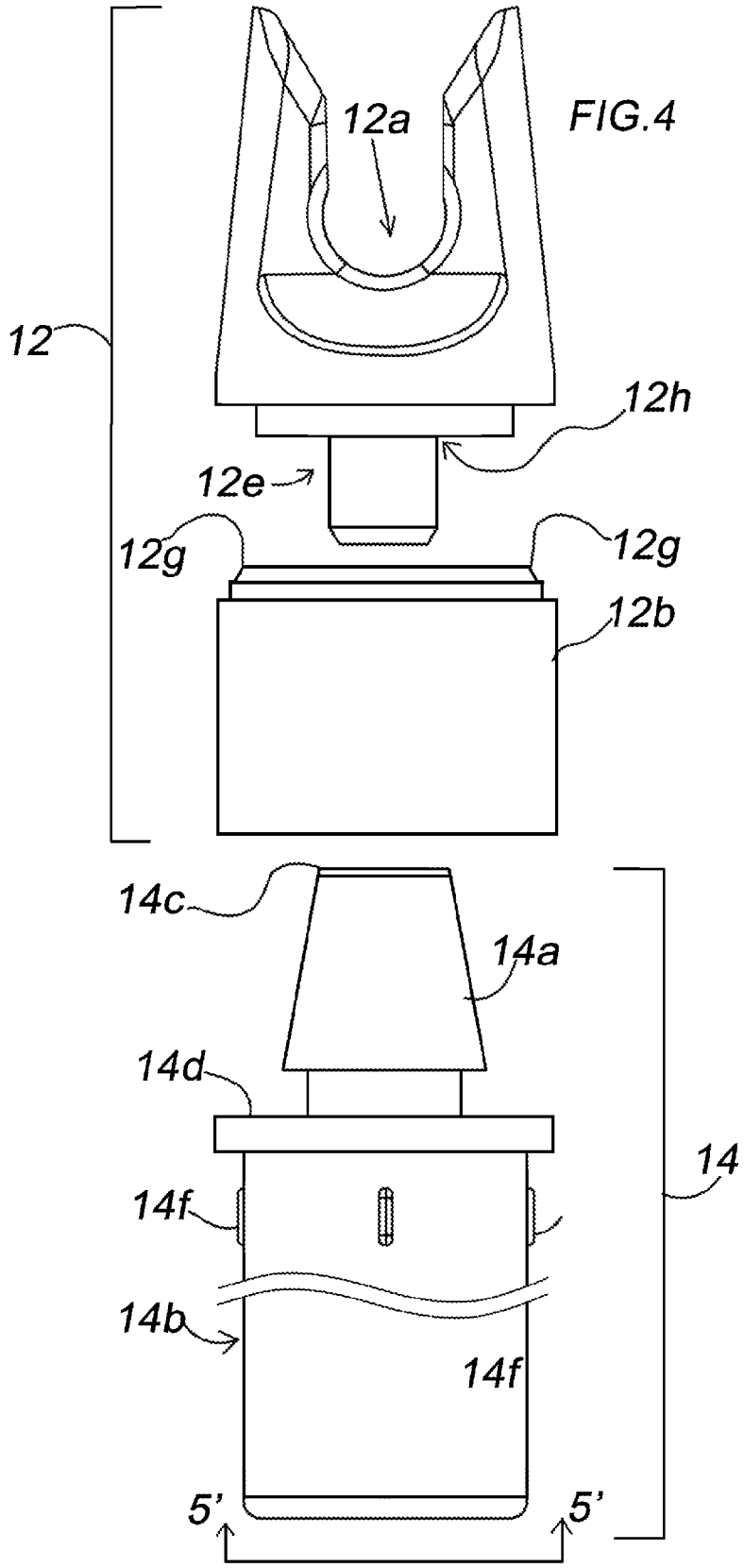
FIG. 4 is an exploded view of the embodiment depicted in (FIG. 3)

FIG. 4 shows a exploded plan view of various elements, including the bowstring rest portion 12*a*, underside of bowstring rest portion 12*e*, joining portions 12*g* of the bowstring rest portion and upper annulus of the collar adapted for ultrasonic welding, retainer portion 14 with plate 14*d* and projection 14*a* which is topped by a bearing surface sized and shaped for intimate contact with the underside of the bowstring rest portion.

Figure 5:
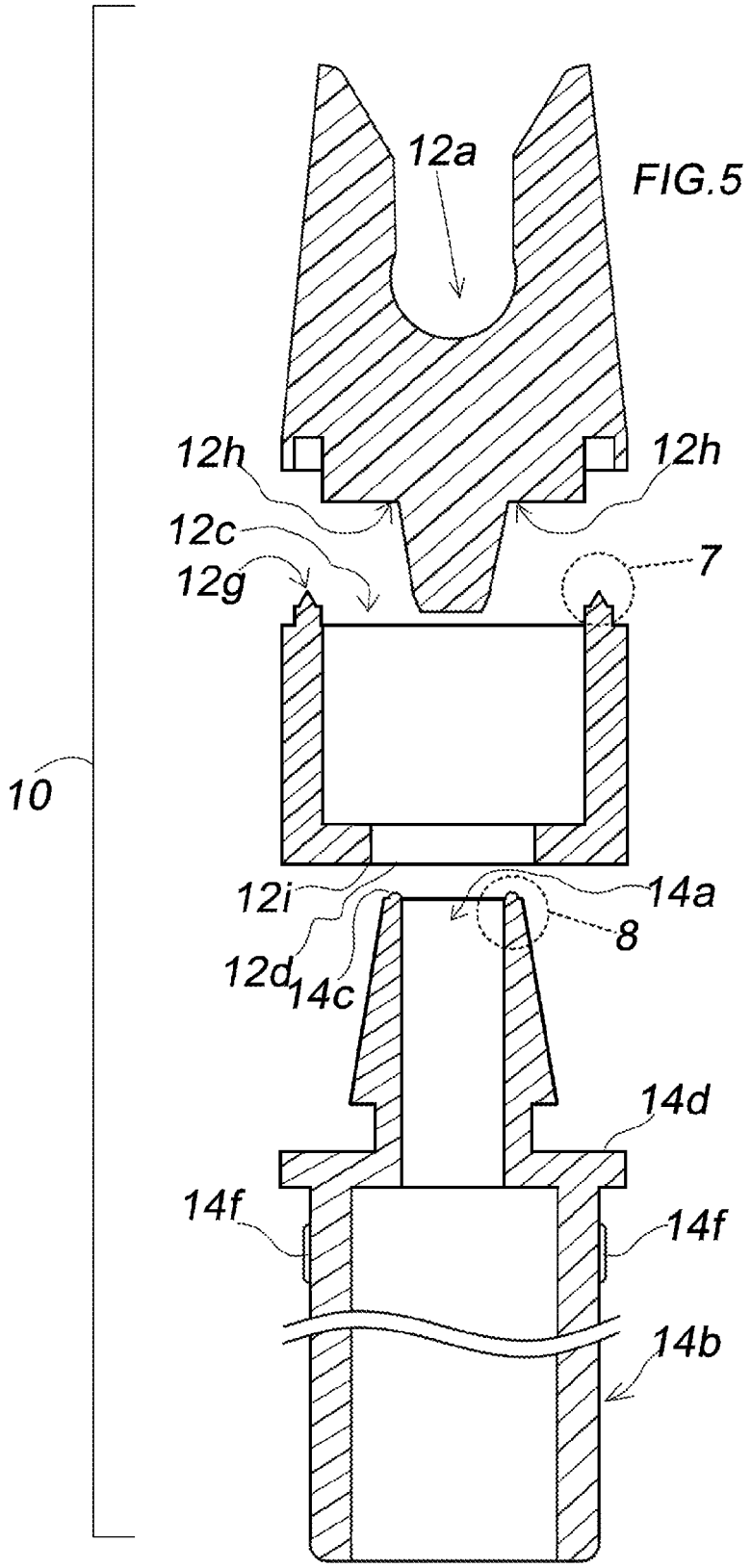
FIG. 5 is a sectional view taken along lines 5'-5' of (FIG. 4)

FIG. 5 is a cross-sectional view of (FIG. 4) taken along lines 5'-5' that depicts an exemplary ultrasonic weld joint 12*g* having an energy director point. Other joint configurations optimized for ultrasonic welds are known in the art, and accordingly, it is not intended that the invention be limited by the particular joint configuration shown.

FIG. 6 is a cross-sectional view taken along lines 6'-6' of (FIG. 2) showing mock assembly 10. Upper collar annulus 12*c* is sonically welded to a mating recess of the bowstring rest portion or alternately affixed thereto by gluing. When surrounded by collar 12*b*, underside 12*e* of the bowstring rest portion and the collar are unconnected to the retainer and free to rotate. Topping projection 14*a* is a thrust bearing surface for contact with the nexus of the bowstring rest portion and the nock base. Preferably the retainer and nock base are constructed of a material with a low coefficient of friction such as Delrin®. Clearances between the nock base and the interior wall of the collar, and the clearances between the bottom of the nock and the upper portion of the shaft attachment preferably range from 0.002 in. to 0.010 in.

Once the nock assembly is coupled to an arrow shaft, it is superficially indistinguishable from a conventional nock (FIG. 2), and the arrow is nocked like any other. The rotationally free bowstring rest portion 12*a* works similarly to a conventional fixed nock with the exception that the retainer portion can rotate independently of the bowstring rest portion and allow the fletching 18, and thus the entire arrow shaft, to begin spinning upon release of the bowstring from the fingers or a bowstring release. A drop-away type arrow rest such as the Ripcord® arrow rest may be used to aid in fletching clearance thus permitting the use of larger helical fletching configurations which promote greater spin and stability especially when using larger broadheads.

Referring to FIG. 1, a helical type fletching 18 configuration is shown rotating independently of the bowstring rest portion 12*a* based approximately on a rate of 1 rotation per 3 feet of travel where (t1, t2, t3) represent in order, a fully drawn bowstring, the bowstring mid release and the bowstring at the instant of arrow release. It should be noted that although helical fletching imparts the most rotation to an arrow shaft, straight offset will rotate the shaft as well. Accordingly, it is intended that the invention encompass helical and straight offset fletching configurations.

Figure 9:
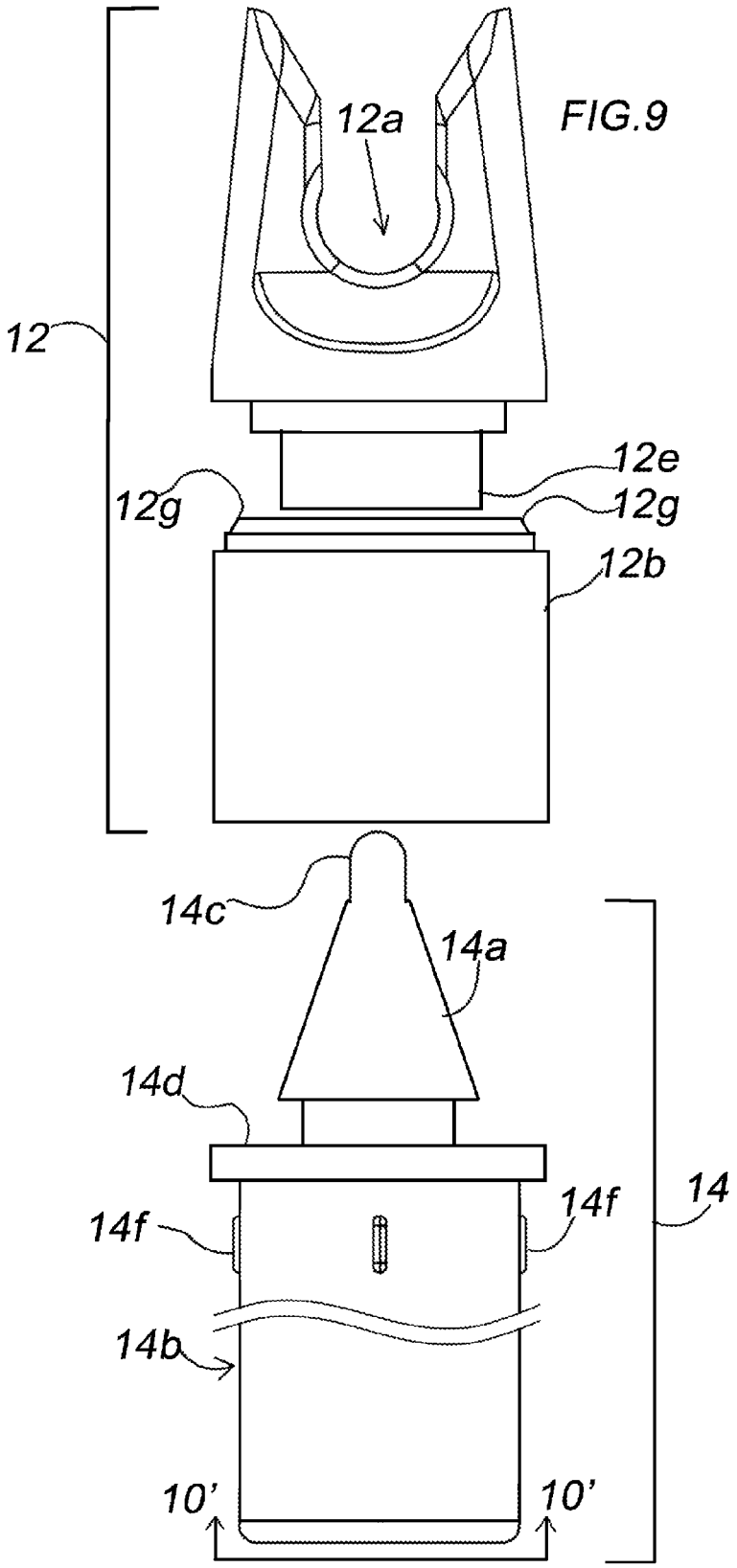
FIG. 9 in one preferred embodiment, is an exploded view of nock assembly 10'.
Figure 10:
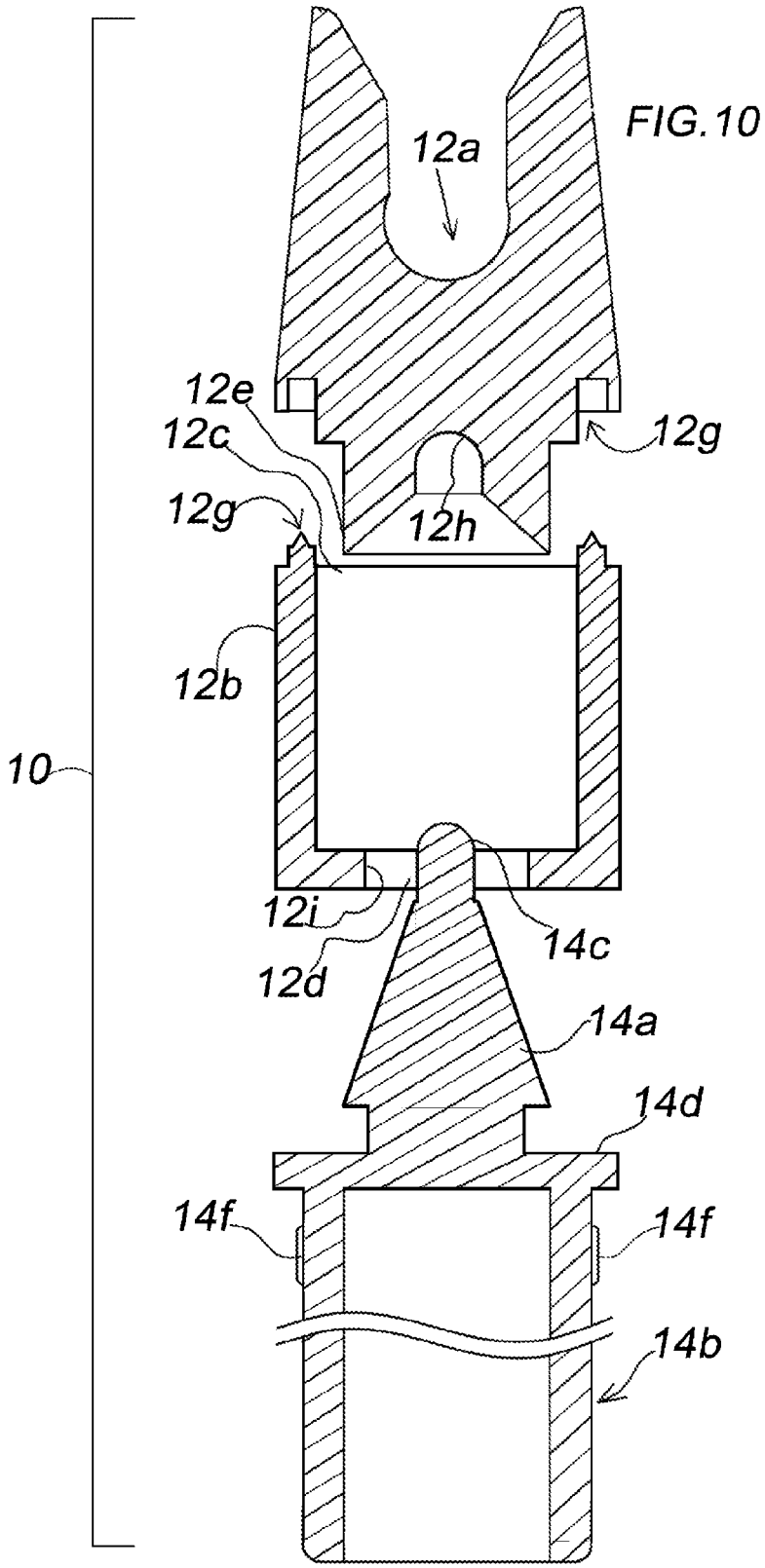
FIG. 10 is cross-sectional view taken along lines 10'-10' of (FIG. 9)
Figure 11:
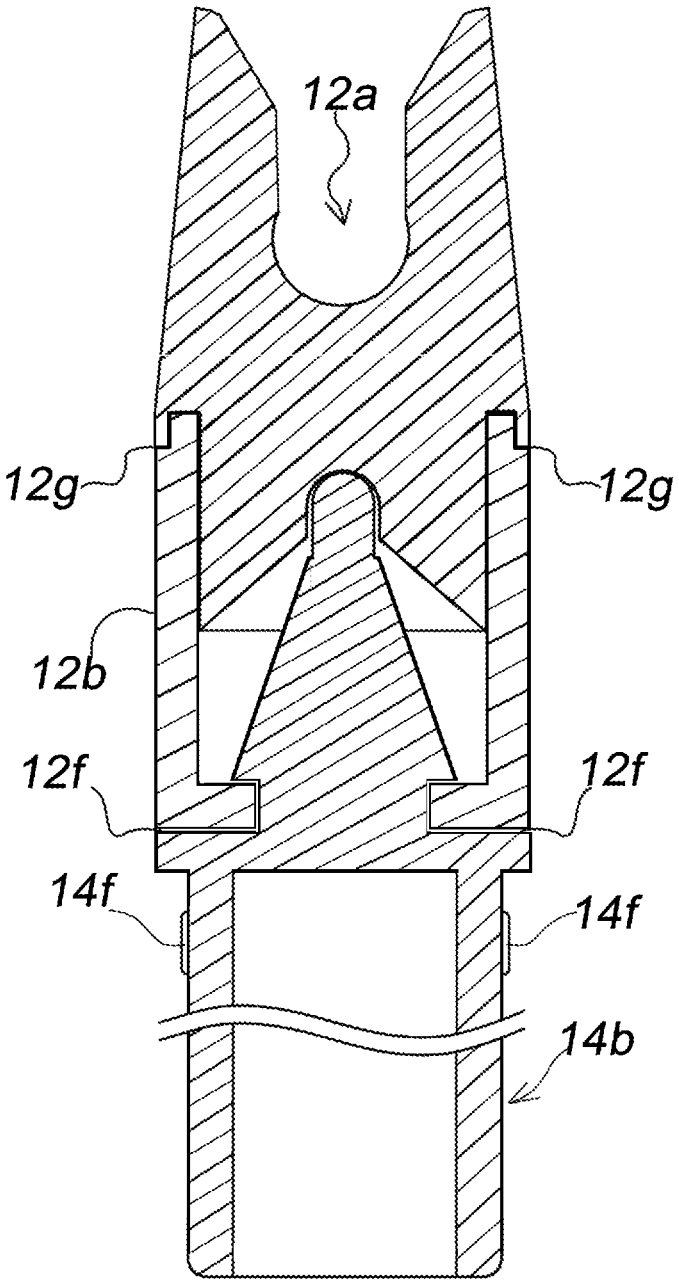
FIG. 11 is a cross-sectional view taken along lines 6'-6' of the nock assembly shown in (FIG. 3)

Referring to FIGS. 9-11, a preferred embodiment includes a recess forming a race 12*h* on the underside 12*e* of the bowstring rest for the seating of the thrust bearing section 14*c* of projection 14*a* during initial acceleration of the arrow shaft.

Although the foregoing description sets forth a preferred embodiment tailored to fit current tubular arrow shafts the retainer shaft coupler of retainer assembly 14 may be produced with a larger diameter and shortened to fit over the end of a solid arrow shaft with the shaft coupler possessing a mating recess, or conversely, the shaft coupler may reduced to fit into a mating recess at the end of the arrow shaft. The mating portions of the arrow shaft and the shaft coupler can be threaded as required. While the invention has been described by the embodiments given, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An interlocking nock assembly for a fletched arrow shaft comprising:

a retainer portion including:

at one end of the retainer portion, a portion sized and shaped to attach to the arrow shaft, and at another end of the retainer portion, a rigid projecting portion topped by a thrust bearing portion;

a nock portion including:

a bowstring rest portion, a collar portion with a bottom end forming an annulus, and, an aperture of the annulus defines a passage to a larger diameter enclosure than a diameter of the annulus, a race portion, and wherein the retainer portion and nock portion are irreversibly coupled; and wherein the race portion is sized and shaped for contact with the thrust bearing portion, and the retainer portion and arrow shaft rotate in a substantially longitudinally fixed position relative to the bowstring rest portion upon release of the bowstring and prior to separation of the bowstring from the bowstring rest portion.

2. The interlocking nock assembly according to claim 1 further comprising at least one bearing surface between the collar portion and the retainer portion.

3. The interlocking nock assembly according to claim 1 wherein at least one portion is snap-fit coupled to another portion.

4. The interlocking nock assembly according to claim 1 wherein the nock portion and retainer portion are co-axially self-centering during an initial release phase when the race and thrust bearing are forced together.

5. The interlocking nock assembly according to claim 1 wherein portions of the bowstring rest portion bottom are recessed or projecting.

* * * * *